United States Patent [19]

Del Rose

[11] Patent Number: 5,044,024

[45] Date of Patent: Sep. 3, 1991

[54] BED WITH COVERED FOOT PORTION

[75] Inventor: Donald R. Del Rose, Harbor Woods, Mich.

[73] Assignee: Baby World N' Teens, Westland, Mich.

[21] Appl. No.: 520,136

[22] Filed: May 7, 1990

Related U.S. Application Data

[63] Continuation of Ser. No. 50,781, May 18, 1987, abandoned, which is a continuation-in-part of Ser. No. 652,712, Sep. 21, 1984, Pat. No. Des. 292,758.

[51] Int. Cl.[5] ..... A47D 7/00

[52] U.S. Cl. ..... 5/400; 5/414; 5/426; D6/388

[58] Field of Search ..... 5/411, 93.1, 424, 425, 5/414-416, 400; D6/388, 389, 393

[56] References Cited

U.S. PATENT DOCUMENTS

| | | | |
|---|---|---|---|
| D. 167,632 | 9/1952 | Jackson | D6/388 |
| D. 189,741 | 2/1961 | Gatov | D6/388 |
| D. 241,385 | 9/1976 | Roden | D6/388 |
| D. 264,773 | 6/1982 | Sutherland | D6/388 |
| D. 275,912 | 10/1984 | Hydrusko et al. | D6/388 |
| D. 284,334 | 6/1986 | Jao | D6/388 |
| D. 292,758 | 11/1987 | Bethune | D6/388 |
| 1,087,806 | 2/1914 | Miller | 5/414 |
| 4,086,674 | 5/1978 | Chiaradonna | 5/113 |
| 4,319,370 | 3/1982 | Robinson | 5/201 |

OTHER PUBLICATIONS

"Night Racer", A Sales Flyer of Gold Shield Fiberglass, Inc., 11751 Industry Ave., Fontana, Calif. 92335.

*Primary Examiner*—Alexander Grosz

*Attorney, Agent, or Firm*—Reising, Ethington, Barnard, Perry & Milton

[57] ABSTRACT

A bed includes a member adapted to cover the lower portion thereof. The cover may be fabricated to resemble a portion of a motor vehicle and the entire bed may present the aspect of such a vehicle.

9 Claims, 2 Drawing Sheets

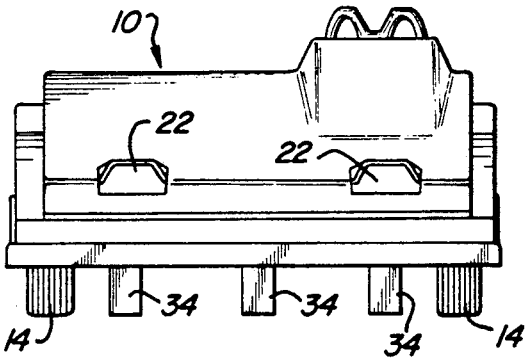
Fig-4
Fig-5
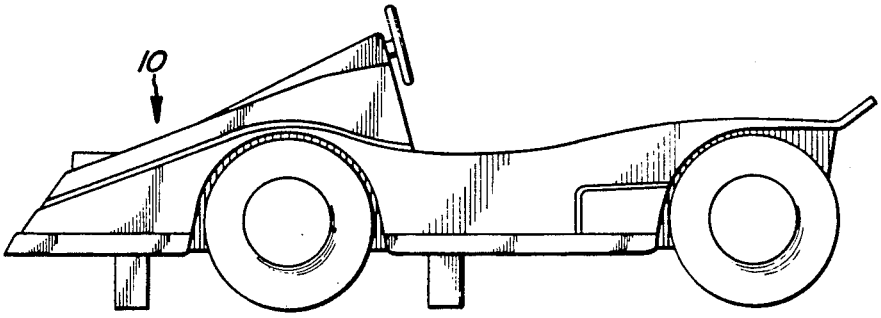
Fig-6
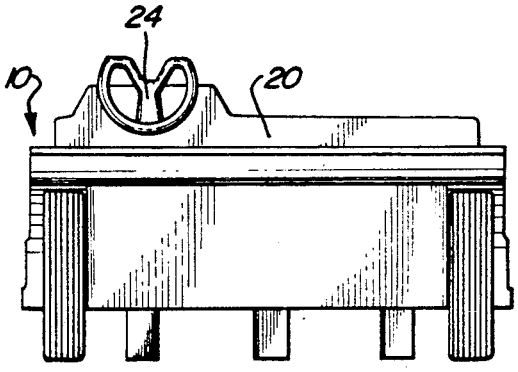
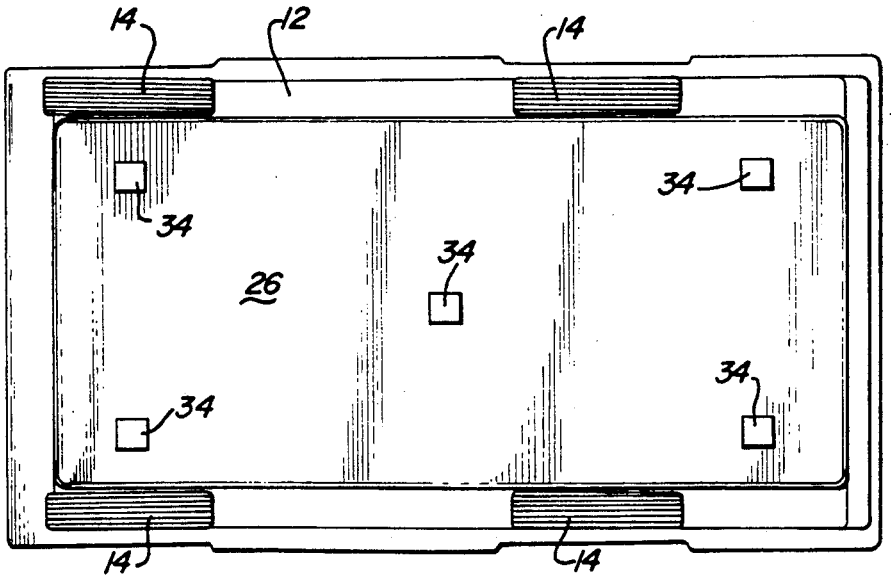
Fig-7

BED WITH COVERED FOOT PORTION

RELATED APPLICATION

This is a continuation of application Ser. No. 050,781, filed May 18, 1987, now abandoned, which is a continuation-in-part of U.S. design patent application Ser. No. 652,712, filed Sept. 21, 1984, now U.S. Pat. No. D292,758.

FIELD OF THE INVENTION

This invention relates generally to bedsteads and in particular to a bed having a covered foot portion. The invention specifically includes a bed adapted to resemble an automobile, the covered foot portion thereof simulating the hood and dashboard of the automobile.

BACKGROUND OF THE INVENTION

Beds are ubiquitous items of furniture which have been essentially unchanged in outward appearance for many years. Beds in the form of motor vehicles and the like have recently been introduced and have gained widespread popularity with children. Such beds generally have the form of a decorative platform representing an automobile or the like. Simulation of an automobile is accomplished by including wheels and indicia bearing automotive names thereon. While such beds are popular with children, they are not fully realistic insofar as a large portion of the visual aspect thereof is taken up with a mattress and bedding.

According to the present invention, there is provided a bed configured to resemble an automobile. The bed includes a cover which simulates the hood and dashboard of the automobile together and a lower frame portion which simulates the remainder of the automobile body. The bed of the present invention has several notable advantages over previously available vehicle-type beds. The appearance of the bed of the present invention is more realistic than those heretofore available because of the presence of the cover.

The cover portion also confers protection to a sleeping child by stopping drafts from striking the child and additionally, by preventing the child from falling out of bed. The bed of the present invention is well adapted to serve an additional function as a plaything in the child's bedroom, and the cover also conceals a portion of the bedding, thereby presenting a neater appearance to the child's room. These and other useful advantages of the present invention will be readily apparent from the drawings, descriptions and claims which follow.

BRIEF DESCRIPTION OF THE INVENTION

There is disclosed herein a bed comprising a base adapted to support a mattress, bedding and sleeper thereupon, and a rigid cover supported by the base in spaced apart relationship therewith so as to define a cavity adapted to receive at least a portion of the mattress, bedding and sleeper therewithin.

In particular, the present invention relates to a bed adapted to resemble an automobile. The bed comprises a base having a generally rectangular deck adapted to support a mattress, bedding and sleeper thereupon. The base includes a plurality of legs adapted to support the deck in spaced apart relation with a subjacent surface as well as a frame surrounding the deck. The frame has the visual appearance of the lower body of an automobile and includes a plurality of simulated tires thereupon. The frame and deck cooperate to at least partially bound a rectangular space adapted to retain the mattress therein. The bed further includes a rigid cover having a width substantially equal to the width of the frame and a length which is less than the length of the frame. The cover has the visual appearance of the hood and dashboard of an automobile and is supported by the frame in spaced apart relationship with the deck so as to define a cavity adapted to receive at least a portion of the mattress, bedding and sleeper. A bed thus configured protects and shields at least a portion of a sleeper's body and resembles an automobile in external appearance.

The bed may further include a simulated steering wheel as well as a pair of simulated headlights associated with the cover. The cover may be removable from the frame or may be hingedly attached thereto so as to allow access to the bedding therewithin.

BRIEF DESCRIPTION OF THE DRAWING

FIG. 4 is a front elevational view of the bed of FIG. 1;

FIG. 5 is a left side elevational view of the bed of FIG. 1;

FIG. 6 is a back elevational view of the bed of FIG. 1; and,

FIG. 7 is a bottom plan view of the bed of FIG. 1.

DETAILED DESCRIPTION OF THE DRAWINGS

Figure 1:
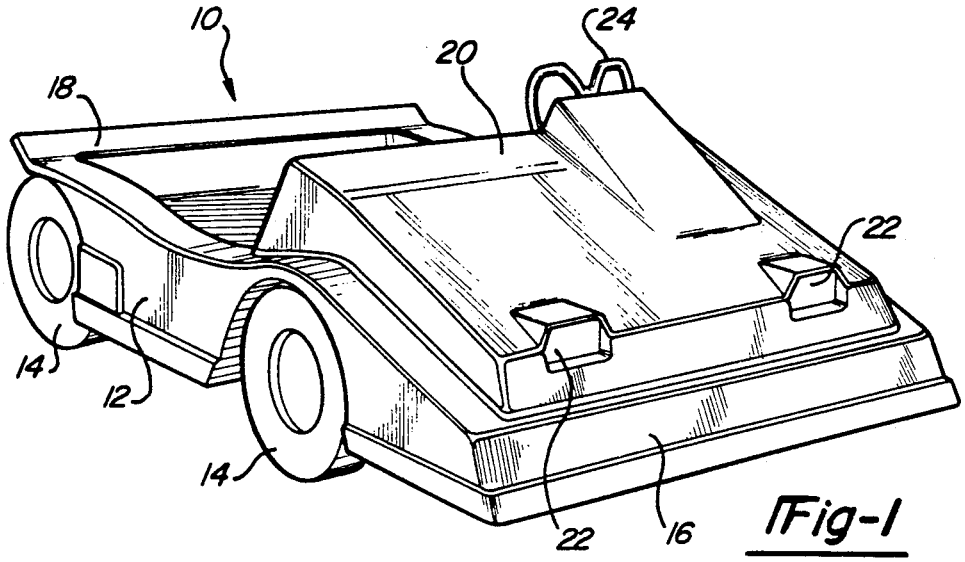
FIG. 1 is a perspective view of a particular bed structured in accord with the principles of the instant invention and configured to resemble an automobile.

Referring now to FIG. 1, there is shown a bed 10 structured in accord with the principles of the instant invention and configured so as to resemble a racing car. The bed 10 of FIG. 1 includes a base and cover. The base includes a generally rectangular deck (not visible in this view) adapted to support a mattress, bedding and sleeper thereon. The base further includes a frame 12 surrounding the deck and presenting the visual appearance of the lower portion of the body of an automobile. Toward this end, the frame 12 includes a plurality of simulated tires 14. Additionally, the frame 12 is configured so as to simulate a front grille portion 16 and a rear air spoiler 18 of an automobile.

Disposed upon the frame 12 is a cover 20. The cover 20 is of a width substantially equal to the width of the frame 14 but of a length less than the frame's length. The cover 20 simulates the visual appearance of the hood and dashboard of an automobile, and toward this end the embodiment depicted includes a pair of simulated headlights 22 as well as a simulated steering wheel 24. It should be noted that for additional realism, the headlights 22 can include therein electric lightbulbs and the steering wheel 24 may include a horn. The cover 20 further cooperates with the frame 12 to define a cavity therebetween into which a portion of the bedding, mattress and body of the sleeper utilizing the bed may fit. This cavity encloses preferably the lower half of the sleeper's body and provides protection from drafts as well as preventing the sleeper from falling out of bed. In the daytime, a child may employ the bed as a toy, and toward that end the child may sit with his or her feet projecting into the cavity defined by the cover 20 while gripping the steering wheel 24.

Figure 2:
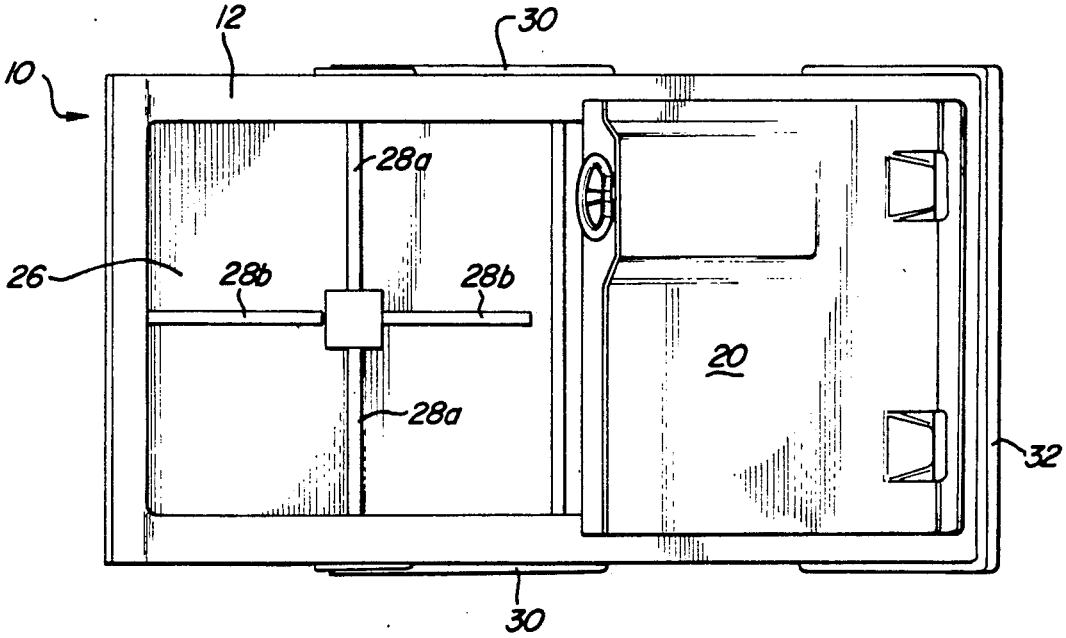
FIG. 2 is a top plan view of the bed of FIG. 1.

Referring now to FIG. 2, there is shown a top plan view of the bed of FIG. 1 better illustrating the deck 26 associated with the base. The deck 26 is a generally rectangular, planar member adapted to support the mattress, bedding and sleeper thereupon. The deck 26 is preferably made from wood, metal or other such sturdy material and, as illustrated herein, includes a pair of stiffening braces 28*a*,28*b* to add extra strength and rigidity thereto. The deck 26 is bounded by the frame 12 so as to define a rectangular space adapted to retain the mattress therein.

The cover 20 may be adapted to lift off the frame 12 to allow access to the mattress for changing bedding and the like. In particular embodiments, the cover 20 may be affixed to the frame 12 by hinges or the like so as to allow for it to be swung into an upright position for changing the bedding. As is readily apparent from the view of FIG. 2, the frame 12 may have various indicia molded therein simulating doors 30 or a bumper 32 of the automobile.

Figure 3:
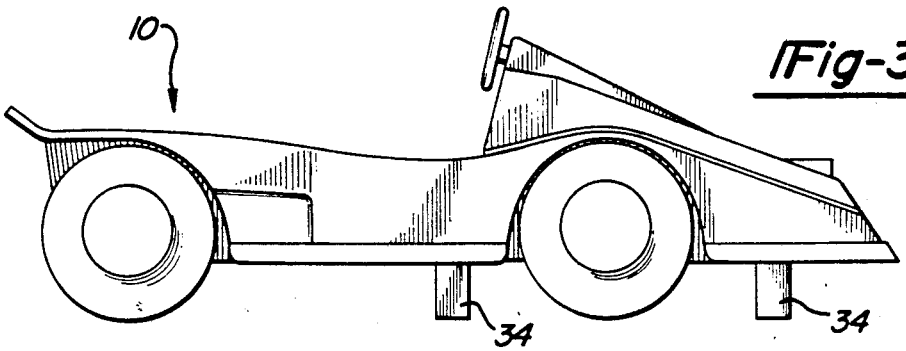
FIG. 3 is a right side elevational view of of the bed of FIG. 1.

Referring now to FIG. 3, there is shown a side view of the bed 10, illustrating two of the legs 34 which are utilized to support the deck 26 and hence the entire bed 10 in spaced apart relationship from a subjacent floor. FIG. 4 is a front view of the bed of FIG. 1 depicting in greater detail the headlamps 22, tires 14 and support legs 34 thereof. FIG. 5 is a view of the left side of the bed 10. FIG. 6 is a view of the rear of the bed 10 showing in better detail the portion of the cover 20 as configured to resemble a dashboard and as including a simulated steering wheel 24.

Referring now to FIG. 7, there is shown a bottom view of the bed depicting more clearly the support legs 34 as affixed to the bottom surface of the deck 26. Also apparent is the frame 12 showing its spatial relationship with the deck 26 and indicating the placement of the tires 14.

The bed of the present invention may be adapted for use with a variety of mattresses and beddings. Because of the strength of the deck and the placement of the legs, a heavy mattress such as a water mattress may be advantageously employed therewith as may conventional types of mattresses.

There are a wide variety of materials which may be employed to fabricate beds in accord with the present invention including wood, metals and plastics. It is generally preferred that the deck 26 be fabricated from a sturdy material such as wood, hardboard, pressed board and the like. The frame 12 and cover 20 include complex contours and are most advantageously fabricated from a synthetic polymeric material by molding or casting processes. Among such materials are fiberglas resins, molded polyethylene, polystyrene, epoxy compositions and the like.

Obviously, other modifications and additions may be made to the bed depicted herein to further enhance it simulation of a motor vehicle. For example, simulated tailpipes, dashboard instrumentation, and the like may be utilized therewith.

Obviously, other embodiments of the present invention than those depicted herein may be manufactured. For example, the outward configuration need not be limited to that of an automobile. Slight modification of the design depicted herein may be made so as to fabricate a bed resembling a boat or an airplane. Likewise, more fanciful shapes such as space vehicles, animals and the like may be made in accord with the principles disclosed herein. Such other variants will advantageously include a cover portion for the protection of the sleeper and for enhanced visual effect. It may, in some instances, be desirable to fabricate a bed having a covered foot portion, which bed does not present the aspect of any type of vehicle or specialized object. A bed may be fitted with a cover surrounding a portion of the sleeper so as to provide additional warmth and/or protection.

In light of the foregoing, it should be readily apparent that the drawings, description and discussion presented herein are not meant to be limitations upon the practice of the instant invention but rather illustrations thereof. It is the following claims, including all equivalents, which are meant to define the scope of the present invention.

I claim:

1. A low profile bed adapted to resemble a low slung automobile, said bed comprising:

a base having a generally rectangular deck adapted to support a mattress, bedding and sleeper thereupon, said base including a plurality of legs adapted to support said deck in spaced apart relationship with a subjacent surface, and a low-rise frame surrounding said deck, said frame having the low-profile visual appearance of the lower body of a low slung automobile and including a plurality of simulated tires thereupon, said frame and deck cooperating to at least partially bound a rectangular space adapted to retain the mattress therein;

said bed further including a rigid, one piece cover having a width substantially equal to the width of the frame, a length less than the length of the frame and having the visual appearance of the hood and dashboard of an automobile, said cover supported by said low rise frame in spaced apart relationship with said deck so as to define a cavity having a height less than its width and length, said cavity being adapted to receive at least a portion of the mattress, bedding and sleeper, whereby said bed (a) protects and shields at least a portion of the sleeper's body and (b) resembles an automobile in external appearance.

2. A bed as in claim 1, wherein said cover further includes a simulated steering wheel.

3. A bed as in claim 1, wherein said cover further includes a pair of simulated headlights.

4. A bed as in claim 1, wherein said frame includes four simulated tires thereupon at least one of said tires covering at least one of said legs to block visibility thereof.

5. A low profile bed adapted to resemble a low slung automobile, said bed comprising:

a base having a generally rectangular deck adapted to support a mattress, bedding and sleeper thereupon, said base including a plurality of legs adapted to support said deck in spaced apart relationship with a subajacent surface, and a low-rise frame surrounding said deck, said frame having the low-profile visual appearance of the lower body of a low slung automobile and including a plurality of simulated tires thereupon, said frame and deck cooperating to at least partially bound a rectangular space adapted to retain the mattress therein, said bed further including a rigid cover having a width substantially equal to the width of the frame, a length less than the length of the frame and having the visual appearance of the hood and dashboard of an automobile, said cover supported by said low-rise frame and extending from a point near one end of said frame to a point intermediate the ends of said frame, a simulated steering wheel mounted on said cover, said cover being in spaced apart relationship with said deck so as to define a cavity having a height less than its width and length, said cavity being adapted to receive at least a portion of the mattress and bedding, whereby said bed resembles an automobile in external appearance.

6. A bed as in claim 5 wherein said frame includes four simulated tires thereupon, at least one of said tires being disposed opposite one of said legs to thereby substantially block visibility of said one of said legs from one side of said bed.

7. A bed as in claim 5 wherein said cover further includes a pair of simulated headlights.

8. A bed as in claim 5 wherein said cover is removable from said frame.

9. A bed as in claim 5 wherein said cover is hingedly attached to said frame.

* * * * *